US008000624B2

(12) United States Patent
Kim

(10) Patent No.: US 8,000,624 B2
(45) Date of Patent: Aug. 16, 2011

(54) FUSING CIRCUIT FOR DRIVING OPERATION OF HEATING UNIT IN AN IMAGE FORMING APPARATUS AND CONTROL METHOD THEREOF

(75) Inventor: Se-joong Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 462 days.

(21) Appl. No.: 12/131,255

(22) Filed: Jun. 2, 2008

(65) Prior Publication Data

US 2009/0047034 A1 Feb. 19, 2009

(30) Foreign Application Priority Data

Aug. 13, 2007 (KR) ..... 10-2007-0081421

(51) Int. Cl.
*G03G 15/00* (2006.01)

(52) U.S. Cl. ..... 399/88

(58) Field of Classification Search ..... 399/88, 399/33, 320

See application file for complete search history.

(56) References Cited

FOREIGN PATENT DOCUMENTS

JP 2006235305 A * 9/2006
JP 2007139907 A * 6/2007

OTHER PUBLICATIONS

Computer translation for JP2007-139907A, Jun. 7, 2007.*
Computer translation JP2006-235305A, Sep. 7, 2006.*
Chinese Office Action mailed Apr. 13, 2011 in connection with counterpart Chinese Application Partial.

* cited by examiner

*Primary Examiner* — Quana M Grainger
(74) *Attorney, Agent, or Firm* — Staas & Halsey LLP

(57) ABSTRACT

An image forming apparatus is provided with: a heating unit which generates heat to fuse a toner on a printing medium; a switch which selectively supplies alternating current (AC) power to the heating unit; a first switching driver which drives the switch to supply the AC power to the heating unit; and a first supply limiter which allows the AC power to be supplied to the heating unit by the first switching driver if a polarity of the AC power is the same as a preset polarity, and cuts off the AC power supplied to the heating unit if the polarity of the AC power is opposite to the preset polarity.

20 Claims, 9 Drawing Sheets

FUSING CIRCUIT FOR DRIVING OPERATION OF HEATING UNIT IN AN IMAGE FORMING APPARATUS AND CONTROL METHOD THEREOF

CROSS-REFERENCE TO RELATED APPLICATION

This application claims all benefits accruing under 35 U.S.C. §119 from Korean Patent Application No. 2007-81421, filed on Aug. 13, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus which fuses a toner on a printing medium to form an image, and a control method thereof.

2. Description of the Related Art

An image forming apparatus, such as, a laser printer, a photo-copier, a facsimile machine and a multi-functional product, typically utilizes a heating unit and a fusing circuit to fuse a toner on a printing medium, such as, paper to form an image.

FIG. 1 illustrates a typical fusing circuit for driving operation of a heating unit in an image forming apparatus. As shown in FIG. 1, the image forming apparatus may include a heating unit 11, such as, a lamp which heats a toner to be fused on a printing medium, and a fusing circuit 10 arranged to drive the heating unit 11. The fusing circuit 10 includes a triac Q1 (i.e., bidirectional triode thyristor) disposed between an alternating current (AC) source and the heating unit 101, a transistor Q2 coupled to receive a control signal, and a photo-coupler PC1 including a light emitter PC1*a* and a light receiver PC1*b* to control operation the triac Q1 based upon receipt of the control signal, via the transistor Q2.

The detailed operation of the fusing circuit 10 is as follows. If a level of a control signal is low, the transistor Q2 is turned OFF. Then, a current does not flow through the light emitter PC1*a*, and the light receiver PC1*b* is turned OFF. In this case, a trigger signal is not generated by the light receiver PC1*b* of the photo-coupler PC1. If the triac Q1 is turned OFF, alternating current (AC) power is not supplied to the heating unit 11.

Meanwhile, if a level of a control signal is high, the transistor Q2 is turned ON. Then, a current corresponding to DC power Vcc flows through the light emitter PC1*a*, and the light receiver PC1*b* is turned ON. If the light receiver PC1*b* is turned ON, the triac Q1 is also turned ON, thereby establishing a supply path of AC power to the heating unit 11. Then, the AC power is supplied to the heating unit 11, thereby heating the heating unit 11 to a preset temperature for a fusing operation. However, if a polarity of the current flowing through the triac Q1 is reverse, the triac Q1 is turned OFF to cut off the supply path of the AC power to the heating unit 11.

According to the foregoing operation principle, the image forming apparatus may adjust the level of the control signal so as to supply only a half-wave range of the AC power to the heating unit 11. As a result, the heating temperature of the heating unit 11 can be controlled by adjusting the number of half-wave ranges of the AC power supplied to the heating unit 11 for a predetermined time.

In addition, the photo-coupler PC1 may be used to adjust the level of the control signal according to the half-wave range of the AC power. The photo-coupler PC1 is designed to operate by detecting whether a phase of the AC power is reverse. The photo-coupler PC1 remains turned OFF even if the level of the inputted control signal is high. The photo-coupler PC1 may also be designed to be turned ON only after the phase of the AC power is reverse.

However, the photo-coupler PC1 may not accurately detect when the phase of the AC power is reverse due to its own characteristics. The problem will be described with reference to FIG. 2 which illustrates a waveform of the current supplied to the heating unit 11 herein below.

As shown in FIG. 2, an input voltage Vin is inputted to the photo-coupler PC1, and the phase thereof is the same as the phase of the AC power. An output current Iout is supplied to the heating unit 11. As shown therein, if an absolute value of the input voltage Vin is smaller than a preset reference voltage Vth during a range A1 in which the level of the control signal is high, the light receiver PC1*b* of the photo-coupler PC1 is turned ON.

As described above, the light receiver PC1*b* is not turned ON when the input voltage Vin becomes zero, i.e. precisely when the phase of the AC power is reverse, but is turned ON a time, which corresponds to the reference voltage Vth, before the phase of the AC power is reverse. Then, the triac Q1 is also turned ON before the phase of the AC power is reverse. The waveform of the output current Iout supplied to the heating unit 11 is not a complete half wave, and a current having an opposite polarity flows in advance (refer to B1 in FIG. 2). If the waveform of the output current Iout supplied to the heating unit 11 is not the complete half wave, noises, such as an electromagnetic interference (EMI) or harmonics, occur.

FIG. 3 illustrates a graph which shows noises occurring during the operation of the conventional image forming apparatus 10. As shown in FIG. 3, reference numerals D1 and E1 represent the magnitude of the noises measured when the current has the maximum value and the minimum value, respectively. Reference numerals F1 and G1 represent acceptable limits of the noises of D1 and E1, respectively.

As shown therein, noises which exceed the acceptable limits F1 and G1 occur in a low frequency band (approximately 150 KHz to 200 KHz). The noises which exceed the acceptable limits F1 and G1 may cause drastic changes in voltages supplied to electronic devices near the image forming apparatus 10. Such electronic devices may be adversely affected, e.g. may flicker or malfunction due to the noises.

SUMMARY OF THE INVENTION

Several aspects and example embodiments of the present invention provide an image forming apparatus which minimizes noise occurring during a fusing operation and improves reliability, and a control method thereof.

Additional aspects and/or advantages of the invention will be set forth in part in the description which follows and, in part, will be obvious from the description, or may be learned by practice of the invention.

In accordance with an example embodiment of the present invention, an image forming apparatus comprising: a heating unit which generates heat to fuse a toner on a printing medium; a fusing circuit which drives operation of the heating unit, and comprises a switch which selectively supplies alternating current (AC) power to the heating unit; a first switching driver which drives the switch to supply the AC power to the heating unit; and a first supply limiter which allows the AC power to be supplied to the heating unit by the first switching driver if a polarity of the AC power is the same as a preset first polarity, and which cuts off the AC power supplied to the heating unit if the polarity of the AC power is opposite to the first polarity.

According to an aspect of the present invention, the switch may include a triac, and the first switching driver triggers a gate of the triac to supply the AC power to the heating unit.

According to an aspect of the present invention, the first switching driver may include a first photo-coupler which is turned ON upon receipt of a control signal when a polarity of the AC power is reverse.

According to another aspect of the present invention, the first switching driver may further include a first transistor which is turned ON to allow the first photo coupler to operate if the control signal is received.

According to an aspect of the present invention, the first supply limiter may include a first diode which is disposed between the gate of the triac and an output terminal of the first photo-coupler.

According to another aspect of the present invention, the fusing circuit may further include: a second switching driver which drives the switch to supply AC power having a polarity opposite to that of the AC power supplied by the first switching driver, to the heating unit; and a second supply limiter which allows the AC power to be supplied to the heating unit by the second switching driver if the polarity of the AC power is the same as a second polarity opposite to the first polarity, and which cuts off the AC power supplied to the heating unit if the polarity of the AC power is opposite to the second polarity.

According to a further aspect of the present invention, the second switching driver may include a second photo-coupler which is turned ON upon receipt of a control signal when a polarity of the AC power is reverse, and a second transistor which is turned ON to allow the second photo-coupler to operate if the control signal is received.

According to a further aspect of the present invention, the second supply limiter may include a second diode which is disposed between the gate of the triac and an output terminal of the second photo-coupler.

In accordance with another example embodiment of the present invention, a control method of an image forming apparatus which has a heating unit generating heat to fuse a toner on a printing medium and form an image, the control method including: attempting to supply alternating current (AC) power to the heating unit if a control signal is generated to supply the AC power to the heating unit; and supplying the AC power to the heating unit if a polarity of the AC power to be supplied to the heating unit is the same as a preset polarity, and cutting off the AC power supplied to the heating unit if the polarity of the AC power is opposite to the preset polarity.

According to an aspect of the present invention, the cutting off the AC power may include preventing a trigger signal from being transmitted from an output terminal of a photo coupler turned ON by the control signal, to a gate of a triac selectively supplying the AC power to the heating unit.

In accordance with yet another example of the present invention, an image forming apparatus is provided with a heating unit which generates heat to fuse a toner on a printing medium during a fusing operation to form an image; and a fusing circuit which drives operation of the heating unit to minimize noise from occurring during the fusing operation, the fusing circuit comprising: a switch disposed between a power source and the heating unit, to selectively supply power to the heating unit to generate heat for the fusing operation; a first switching driver arranged to activate the switch to supply power to the heating unit; and a first supply limiter arranged to enable the power to be supplied to the heating unit, via the first switching driver, if a polarity of the power is the same as a preset polarity, and to disable the power supplied to the heating unit if the polarity of the power is opposite to the preset polarity.

According to an aspect of the present invention, the switch corresponds to a triac having a first input terminal connected to the power source, a second input terminal connected to the heating unit, and a gate driven by the first switching driver.

According to another aspect of the present invention, the first switching driver comprises: a first photo-coupler including a light emitter connected to a voltage terminal to emit light upon receipt of a first control signal, and a light receiver connected to the switch to activate the switch when the polarity of the power is reverse; and a first transistor including a first electrode electrically connected to the voltage terminal, via the light emitter of the first photo-coupler, a second electrode connected to ground, and a gate electrode driven upon receipt of the first control signal.

According to another aspect of the present invention, the fusing circuit further comprises: a second switching driver arranged in parallel with the first switching driver, to activate the switch to supply power having a polarity opposite to that of the power supplied by the first switching driver, to the heating unit; and a second supply limiter arranged in parallel with the first supply limiter, to enable the power to be supplied to the heating unit, via the second switching driver, if the polarity of the power is the same as a second polarity opposite to the first polarity, and to disable the power supplied to the heating unit if the polarity of the power is opposite to the second polarity.

According to yet another aspect of the present invention, the second switching driver comprises: a second photo-coupler arranged in parallel with the first photo-coupler, including a light emitter connected to a voltage terminal to emit light upon receipt of a second control signal, and a light receiver connected to the switch to activate the switch when the polarity of the power is reverse; and a second transistor arranged in parallel with the first transistor, including a first electrode electrically connected to the voltage terminal, via the light emitter of the second photo-coupler, a second electrode connected to ground, and a gate electrode driven upon receipt of the second control signal.

According to an aspect of the present invention, the first and second supply limiters comprise first and second diodes arranged in parallel and disposed between the gate of the triac and an output terminal of the first and second photo-couplers.

According to yet another aspect of the present invention, the fusing circuit further comprises: an inductance connected to the power source to remove noise occurring when the power is supplied to the heating unit; a first resistor and a first capacitor connected in series, and disposed between the inductance and the output terminals of the first and second photo-couplers, to remove noise occurring when the switch is turned ON; a second resistor and a second capacitor arranged in parallel with the first and second photo-couplers to remove noise occurring when the light receiver of the first and second photo-couplers are turned ON; and a third resistor disposed between the inductance and the light receiver of the first and second photo-couplers.

According to a further aspect of the present invention, the first and second switching drivers further comprise first and second resistors connected to the gate electrode of the first and second transistors. In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
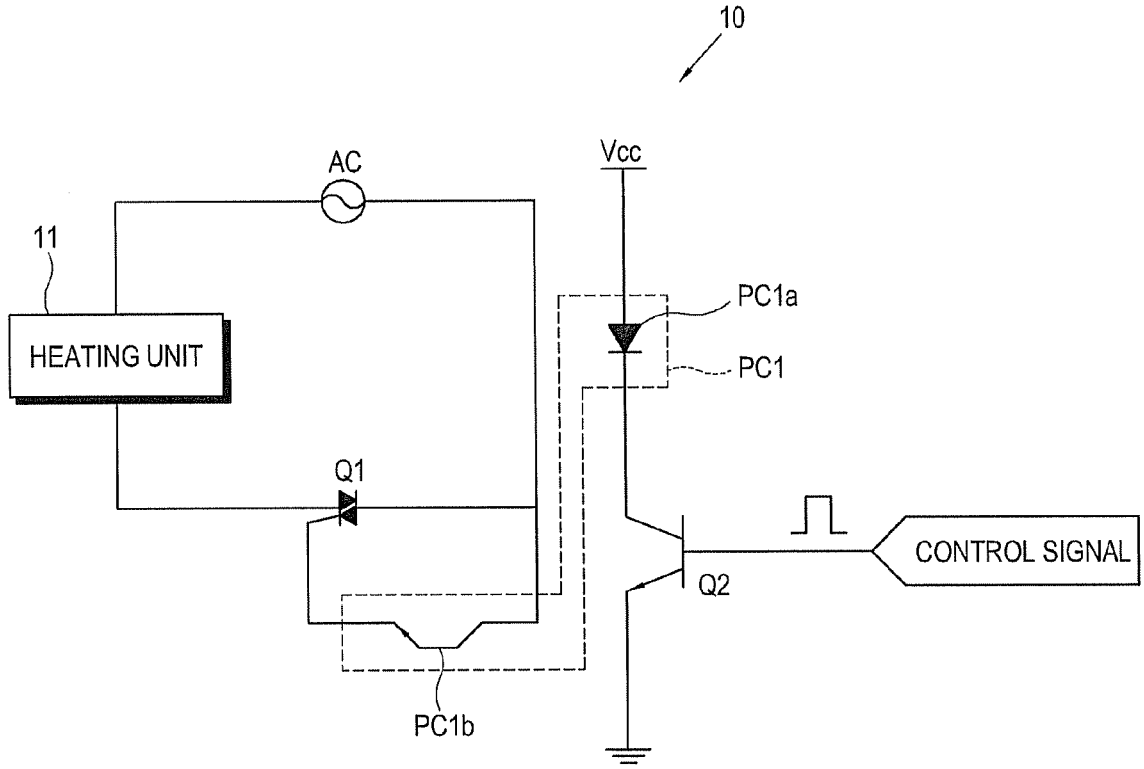
FIG. 1 (RELATED ART)
FIG. 1 is a circuit diagram of a typical fusing circuit for driving operation of a heating unit in an image forming apparatus.
Figure 2:
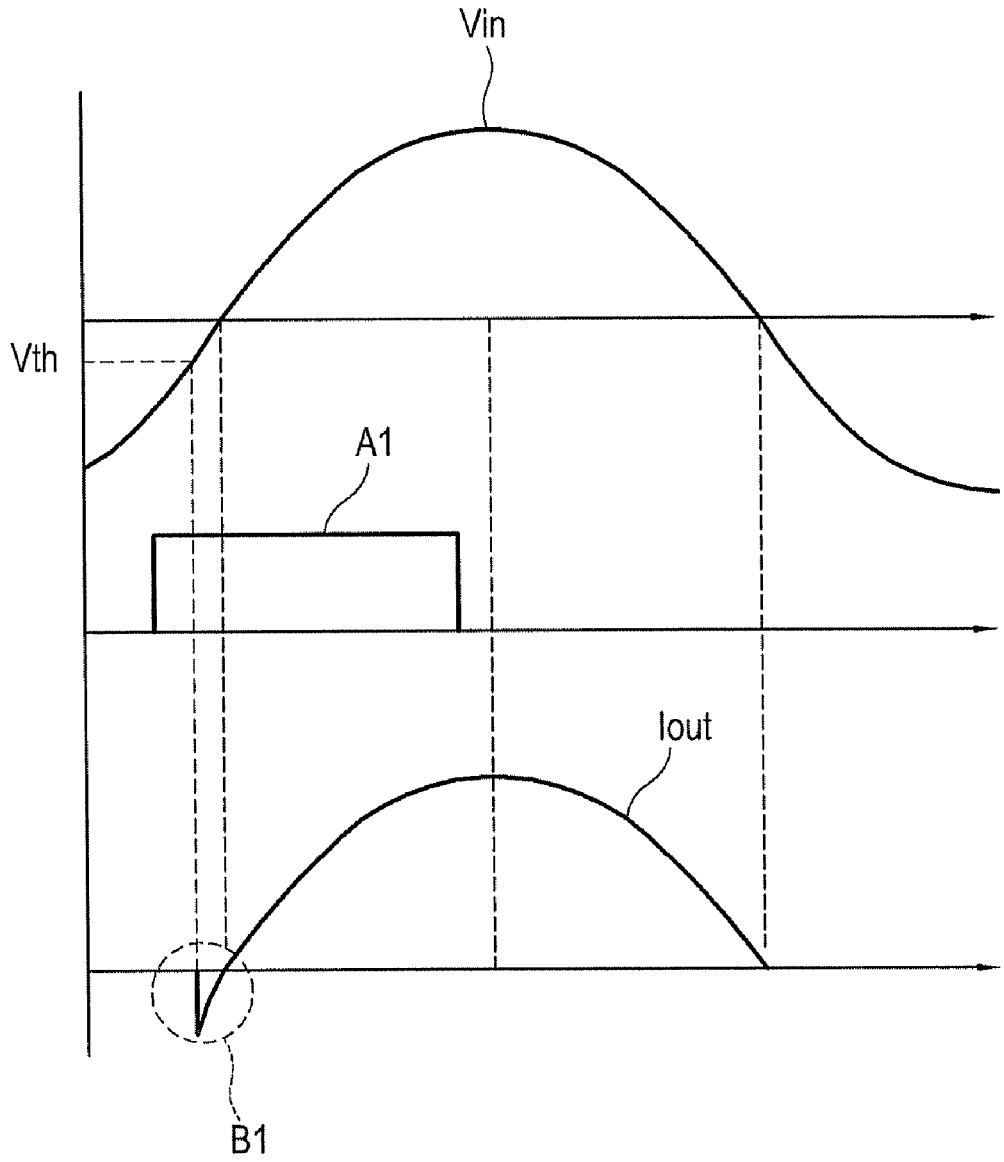
FIG. 2 (RELATED ART)
FIG. 2 illustrates a waveform of a current supplied to a heating unit in an image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
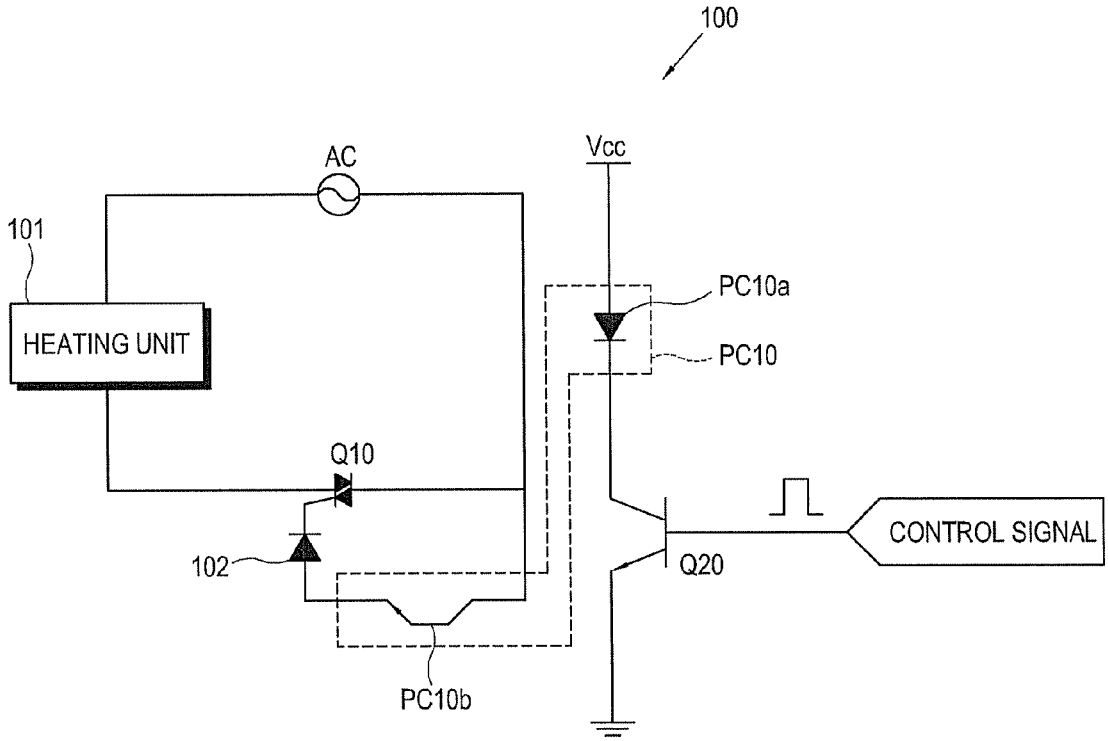
FIG. 4 is a circuit diagram of a fusing circuit for driving operation of a heating unit in an image forming apparatus according to an example embodiment of the present invention.

FIG. 4 is a circuit diagram of a fusing circuit for driving operation of a heating unit in an image forming apparatus according to an example embodiment of the present invention. The image forming apparatus may correspond to a laser printer, a photo-copier, a facsimile machine and a multi-functional product, which fuses a toner on a printing medium, such as, paper to form an image.

The image forming apparatus may include an image processor (not shown) which processes image data to be printed on a printing medium, a laser scanning unit (not shown) which scans laser to the processed image data, a photosensitive drum (not shown) which forms a latent image thereon by the laser scanning unit, a cartridge (not shown) which accommodates a toner therein to be developed on the latent image formed, a transfer roller (not shown) which transfers the developed toner to the printing medium, a fusing unit (not shown) which fuses the transferred toner on the printing medium by heat and pressure, a feeding unit (not shown) which feeds the printing medium, and a power supply (not shown) which supplies operating power to the foregoing elements.

As shown in FIG. 4, the image forming apparatus includes a heating unit 101 such as a lamp to supply heat for a fusing operation, and a fusing circuit 100 arranged to drive operation of the heating unit 101. The heating unit 101 may be included in the fusing unit. The fusing circuit includes a triac Q10 (i.e., a bidirectional triode thyristor) disposed between an alternating current (AC) source and the heating unit 101, which connects or disconnects a supply path of alternating current (AC) power to the heating unit 101; a photo-coupler PC 0 which controls the connection or disconnection of the triac Q10; and a transistor Q20 which controls the operation of the photo-coupler PC10 according to a control signal.

The photo-coupler PC10 includes a light emitter PC10*a* which emits light if a current flows therethrough, i.e., a diode that converts electrical power into light, and a light receiver PC10*b* which is turned ON and OFF according to light emitted by the light emitter PC10*a*. With the foregoing configuration, the fusing circuit 100 allows the AC power to be selectively supplied to the heating unit 101.

The transistor Q20 is disposed between a power terminal Vcc and ground, and includes a collector connected to the power terminal Vcc, via the light emitter PC10*a* of the photo-coupler PC10, an emitter connected to the ground, and a gate electrode coupled to receive a control signal. As shown in FIG. 4, the transistor Q20 is a NPN transistor; however, PNP transistor may also be utilized as well as other IC circuits.

The fusing circuit 100 further includes a diode 102 which is disposed between a gate of the triac Q10 and an output terminal (of the light receiver PC10*b*) of the photo-coupler PC10. An anode of the diode 102 is connected to the light receiver PC10*b*, while a cathode thereof is connected to the gate of the triac Q10. As the diode 102 is disposed in such a direction, a trigger signal is supplied to the gate of the triac Q10 if the polarity of the trigger signal applied to the gate of the triac Q10 is positive (i.e. if a voltage of the anode of the diode 102 is higher than that of the cathode thereof. However, if the polarity of the trigger signal is negative (i.e. if the voltage of the anode of the diode 102 is lower than that of the cathode thereof), the trigger signal is cut off. The operation of the fusing circuit 100 in an image forming apparatus having the foregoing configuration will be described as follows.

First, if a level of the control signal is low, the transistor Q20 is turned OFF. Then, a current does not flow through the light emitter PC10*a*. As the light is not emitted, the light receiver PC10*b* is turned OFF. As the current does not flow through the light receiver PC10*b*, a trigger signal is not generated. If the triac Q10 is turned OFF, the gate of the triac Q10 is not triggered. Then, the triac Q10 remains turned OFF. While the triac Q10 is turned OFF, the AC power is not supplied to the heating unit 101.

If the level of the control signal is high, the transistor Q20 is turned ON. Then, the current corresponding to DC power Vcc flows through the light emitter PC10*a*, and the light receiver PC10*b* is turned ON.

The phase of the current flowing through the light receiver PC10*b* is substantially the same as that of the AC power. Thus, the polarity of the trigger signal generated by the light receiver PC10*b* is the same as that of the AC power. If the polarity of the AC power is positive, i.e. if the polarity of the trigger signal is positive, the trigger signal is supplied to the gate of the triac Q1 through the diode 102. If the triac Q1 is triggered to turn ON, the supply path of the AC power from the AC power source to the heating unit 102 is established. In this case, the AC power from the AC power source is supplied to the heating unit 101 to generate heat. If the polarity of the AC power is turned negative, the triac Q10 is turned OFF to disconnect the supply path of the AC power from the AC power source to the heating unit 101. Then, the AC power from the AC power source is not supplied to the heating unit 101.

If the level of the control signal is high while the polarity of the AC power is negative, the polarity of the trigger signal is also negative. In this case, the trigger signal is blocked by the diode 102 so as not to be supplied to the gate of the triac Q10. If the triac Q10 is turned OFF, the gate of the triac Q10 is not triggered. Thus, the triac Q10 remains turned OFF. While the triac Q10 is turned OFF, the supply path of the AC power to the heating unit 101 is disconnected. Thus, the AC power is not supplied to the heating unit 101.

The photo-coupler PC10 may be designed to operate by detecting whether the polarity of the AC power is reverse. That is, the photo-coupler PC10 remains turned OFF even if the level of the input control signal is high, and may be turned ON only when the phase of the AC power is reverse.

Figure 5:
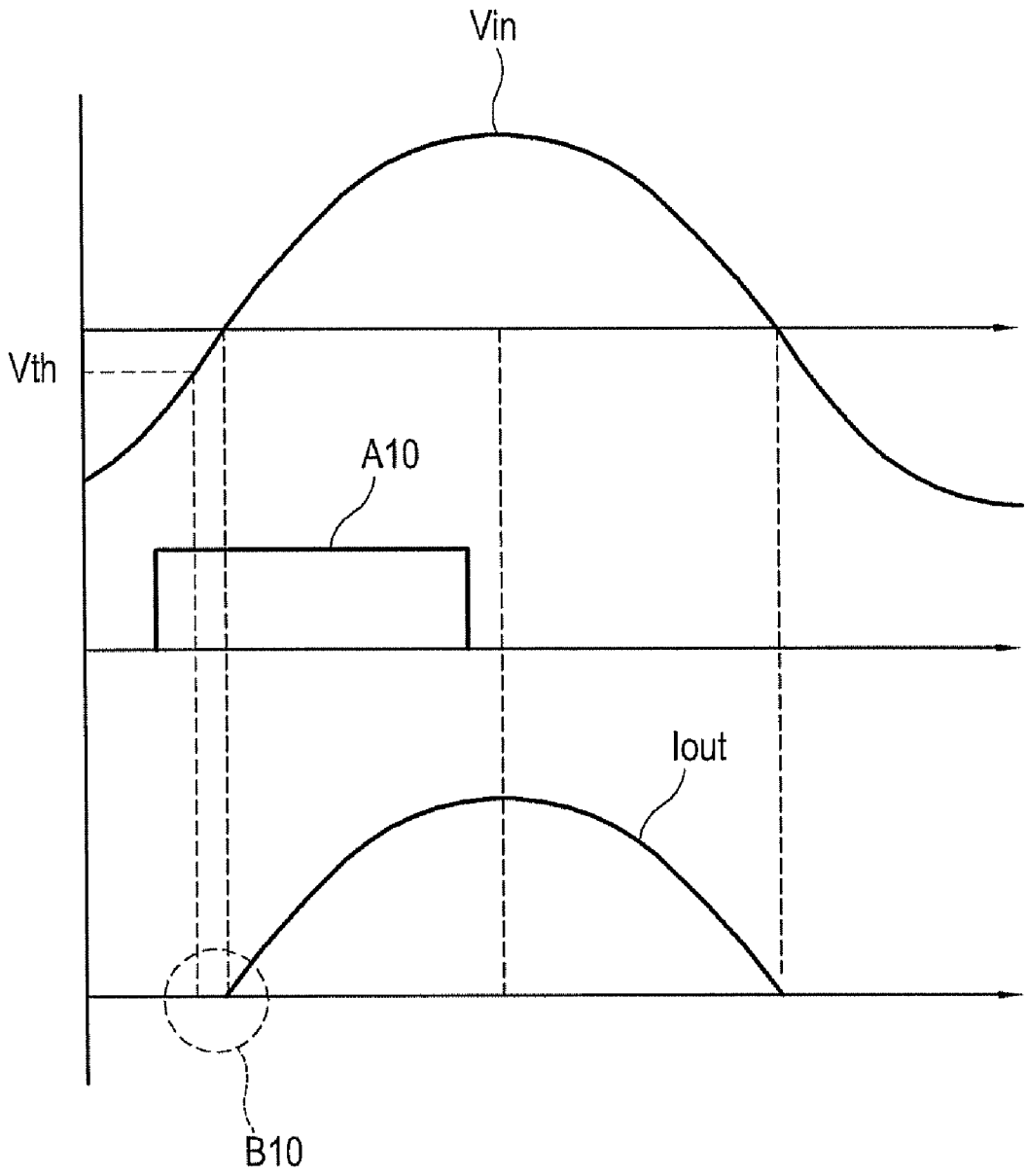
FIG. 5 illustrates a waveform of a current supplied to a heating unit in an image forming apparatus according to an example embodiment of the present invention.

As shown in FIG. 5, if the control signal is high while the polarity of the input voltage Vin having the same phase as the AC power is negative (refer to A10), the photo-coupler PC10 may determine that the polarity of the input voltage Vin is reverse from negative to positive in case that an absolute value of the input voltage Vin is smaller than a preset reference voltage Vth. As a result, the light receiver PC10*b* of the photo-coupler PC10 is turned ON.

However, the polarity of the trigger signal generated by the light receiver PC10*b* is still negative. Thus, the trigger signal is blocked by the diode 102 so as not to be supplied to the gate of the triac Q10. As the triac Q10 remains turned OFF, the AC power is not supplied to the heating unit 101.

Then, the diode 102 operates to allow the AC power to be supplied to the heating unit 101, if a high control signal is applied and the polarity of the AC power supplied to the heating unit 101 is positive. However, if the polarity of the AC power is negative, the diode 102 cuts off the AC power supplied to the heating unit 101.

According to an example embodiment of the present invention, even if the photo-coupler PC10 does not accurately detect when the phase of the AC power is reverse due to its own properties, the AC power having the polarity opposite to the desired polarity is prevented from being supplied to the heating unit 101. Then, noises, such as EMI, are minimized and reliability of the image forming apparatus may improve.

The image forming apparatus may adjust the level of the control signal to supply only a half-wave range of the AC power to the heating unit 101. By adjusting the number of the half wave ranges of the AC power supplied to the heating unit 101 for a predetermined time, the heating temperature of the heating unit 101 may be controlled.

Figure 6:
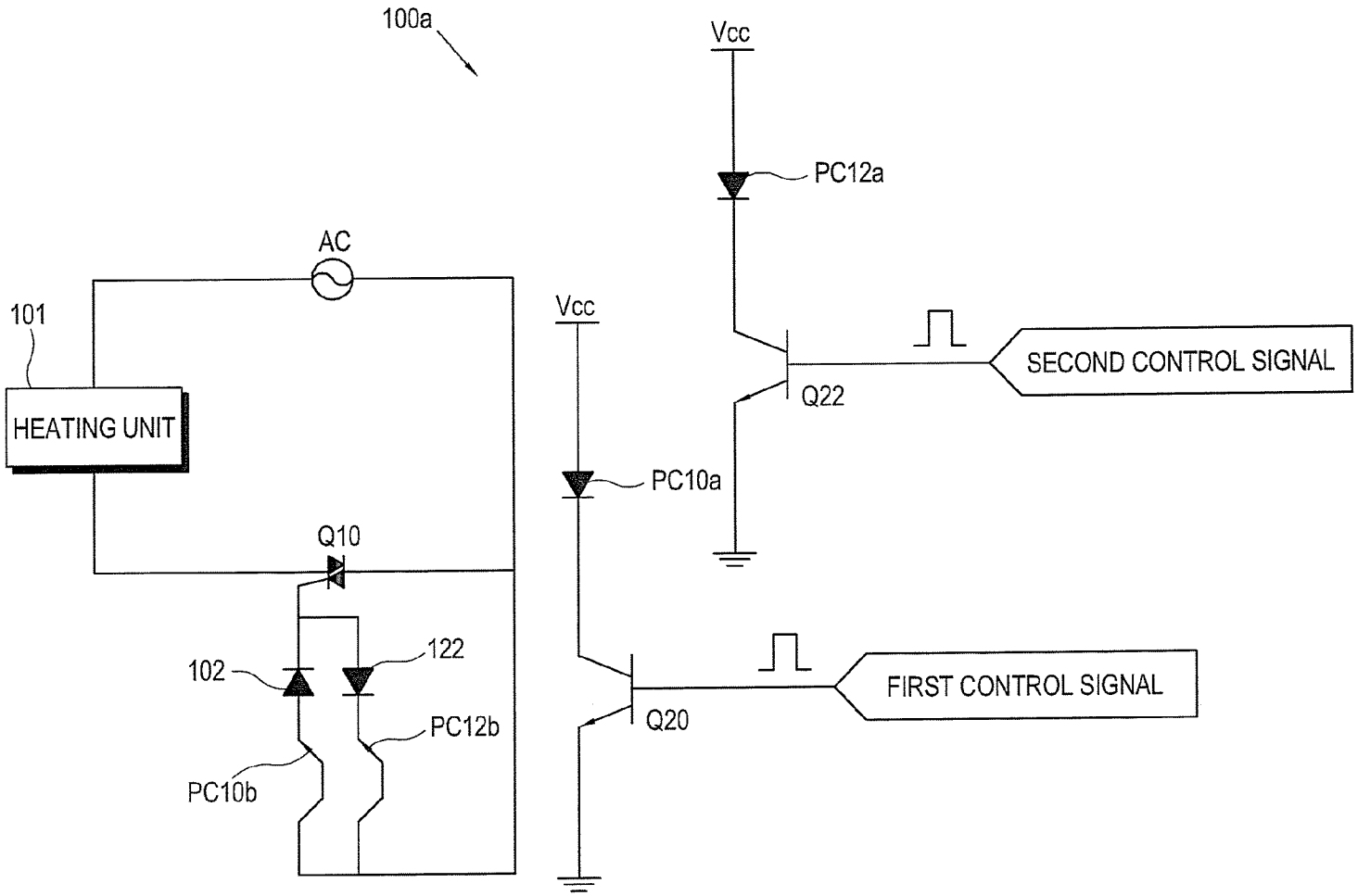
FIG. 6 is a circuit diagram of a fusing circuit for driving operation of a heating unit in an image forming apparatus according to another example embodiment of the present invention.

Hereinafter, an image forming apparatus according to another example embodiment of the present invention will be described. FIG. 6 is a circuit diagram of a fusing circuit for driving operation of a heating unit in an image forming apparatus according to another example embodiment of the present invention. Configurations and functions of the fusing circuit 100*a* and the image forming apparatus equivalent to those of the fusing circuit 100 and the image forming apparatus, shown in FIG. 4, will be omitted for the sake of brevity.

As shown in FIG. 6, the fusing circuit 100*a* includes the same circuit elements, shown in FIG. 4, that is, a triac Q10 (i.e., a bidirectional triode thyristor) disposed between an alternating current (AC) source and the heating unit 101, which connects or disconnects a supply path of alternating current (AC) power to the heating unit 101; first photo-couplers PC10 including a first light emitter PC10*a* and a first light receiver PC10*b*, which control the connection or disconnection of the triac Q10; a first diode 102 disposed between the first light receiver PC10*b* of the first photo-couplers PC10 and the triac Q10, and a first transistor Q20 which controls the operation of the photo-coupler PC10 according to a first control signal.

In addition, the fusing circuit 100*a* may further include second photo-couplers PC12*a* and PC12*b*, which turn ON or turn OFF a triac Q10, and a second transistor Q22 which controls an operation of the second photo-couplers PC12*a* and PC12*b* according to a second control signal.

The second photo-couplers PC12*a* and PC12*b* include a second light emitter PC12*a* which emits light if a current flows therethrough, and a second light receiver PC12*b* which is turned ON or OFF according to light emitted by the second light emitter PC12*a*. For purposes of convenience, marks of the first photo-couplers PC10*a* and PC10*b* and the second photo-couplers PC12*a* and PC12*b* are omitted from FIG. 6. However, the second photo-couplers PC12*a* and PC12*b* are disposed in parallel with the first photo-couplers PC10*a* and PC10*b*.

The fusing circuit 100*a* further includes a second diode 122 which is disposed between a gate of the triac Q10 and an output terminal (of the second light receiver PC12*b*) of the second photo-couplers PC12*a* and PC12*b*. An anode of the second diode 122 is connected to the gate of the triac Q10, while a cathode thereof is connected to the second light receiver PC12*b*. As the second diode 122 is disposed in such a direction, the trigger signal is supplied to the gate of the triac Q10 if a polarity of a trigger signal applied to the gate of the triac Q10 is negative (i.e. if a voltage of the anode of the second diode 122 is higher than that of the cathode thereof. However, if the polarity of the trigger signal is positive (i.e., if the voltage of the anode of the second diode 122 is lower than that of the cathode thereof), the trigger signal is not transmitted.

Hereinafter, the detailed operation of the fusing circuit 100*a*, shown in FIG. 6, will be described. The first control signal of the fusing circuit 100*a* is equivalent or similar to the control signal of the fusing circuit 100, shown in FIG. 4. Thus, the description of the first control signal will be omitted for the sake of brevity.

If a level of the second control signal is low, the second transistor Q22, the second light emitter PC12*a*, the second light receiver PC12*b* and the triac Q10 are not turned ON. In this case, the AC power is not supplied to the heating unit 101.

If a level of the second control signal is high, the second transistor Q22 is turned ON. Then, a current corresponding to DC power Vcc flows through the second light emitter PC12*a*, and the second light receiver PC12*b* is turned ON.

If a polarity of the AC power is negative, i.e. if the polarity of the trigger signal generated by the second light receiver PC12*b* is negative, the trigger signal is supplied to the gate of the triac Q10 through the second diode 122. The triac Q10 is triggered to be turned ON, and the AC power is supplied to the heating unit 101. If the polarity of the AC power is turned positive, the triac Q10 is turned OFF. In this case, the AC power is not supplied to the heating unit 101.

If the level of the second control signal is high while the polarity of the AC power is positive, the polarity of the trigger signal also is positive. Then, the trigger signal is blocked by the second diode 122 so as not to be supplied to the gate of the triac Q10. If the triac Q10 is turned OFF, the gate of the triac Q10 is not triggered. The triac Q10 remains turned OFF. The supply path of the AC power to the heating unit 101 is not established, while the triac Q1 is turned OFF. Thus, the AC power is not supplied to the heating unit 101.

Similarly to the first photocouplers PC10*a* and PC10*b*, if the second control signal is high while the polarity of an input voltage Vin is positive and if an absolute value of the input voltage Vin is smaller than a preset reference voltage Vth, the second photo-couplers PC12*a* and PC12*b* may determine that the polarity of the input voltage Vin is reverse from positive to negative, and may turn ON the light receiver PC12*b*.

However, when the second light receiver PC12*b* is turned ON, the polarity of the trigger signal generated by the second light receiver PC12*b* is still positive. Thus, the trigger signal is blocked by the second diode 122 so as not to be supplied to the gate of the triac Q10. As the triac Q10 remains turned OFF, the AC power is not supplied to the heating unit 101.

If a high-level control signal is applied and the polarity of the AC power supplied to the heating unit 101 is negative, the second diode 122 allows the AC power to be supplied to the heating unit 101. If the polarity of the AC power is negative, the second diode 122 cuts off the AC power supplied to the heating unit 101.

The second control signal may be opposite to the first control signal input to the first transistor Q20, with respect to the polarity of the AC power to be supplied to the heating unit 101. For example, if the first control signal is designed to supply the AC power having a positive polarity to the heating unit 101, the second control signal may be designed to supply the AC power having a negative polarity to the heating unit 101. By adjusting the first and second control signals, one of the positive half-wave range and the negative half-wave range of the AC power may be supplied to the heating unit 101. The first and second control signals may be generated by a control signal generator (not shown) or a main controller of an image forming apparatus.

Figure 7:
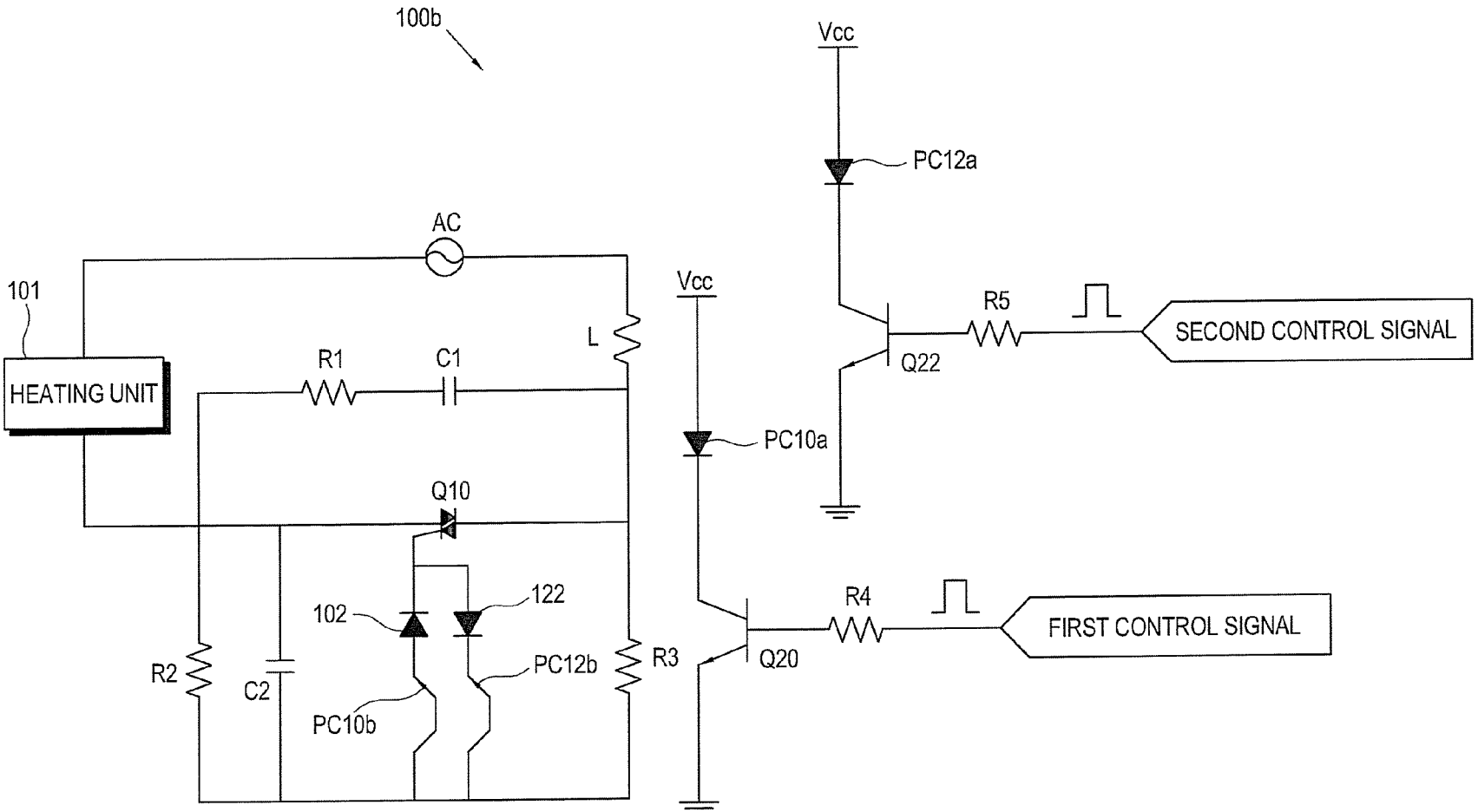
FIG. 7 is a circuit diagram of a fusing circuit for driving operation of a heating unit in an image forming apparatus according to yet another example embodiment of the present invention.

Turning now to FIG. 7, a circuit diagram of a fusing circuit for driving operation of a heating unit in an image forming apparatus according to yet another example embodiment of the present invention is illustrated. Configurations and functions of the fusing circuit 100*b* and the image forming apparatus equivalent or similar to those of the fusing circuit 100 and the image forming apparatus, shown in FIG. 4, and the fusing circuit 100*a* and the image forming apparatus, shown in FIG. 6, will be omitted herein for the sake of brevity.

The fusing circuit 100*b* may further include a first resistor R1, a first capacitor C1, a second resistor R2, a second capacitor C2, an inductor L, a third resistor R3, a fourth resistor R4 and a fifth resistor R5.

The first resistor R1 and the first capacitor C1 remove noises occurring when a triac Q10 is switched. The second resistor R2 and the second capacitor C2 remove noises occurring when a first light receiver PC10*b* and a second light receiver PC12*b* are switched, to stabilize the fusing circuit 100*b*. The inductor L removes noises occurring when the AC power is switched.

The third resistor R3 determines a level of a current flowing through the first and second light receivers PC10*b* and PC12*b*. A resistance value of the third resistor R3 is set to trigger a gate of the triac Q10. The fourth and fifth resistors R4 and R5 determine levels of first and second control signals supplied to bases of the first transistor Q20 and the second transistor Q22, respectively.

Figure 3:
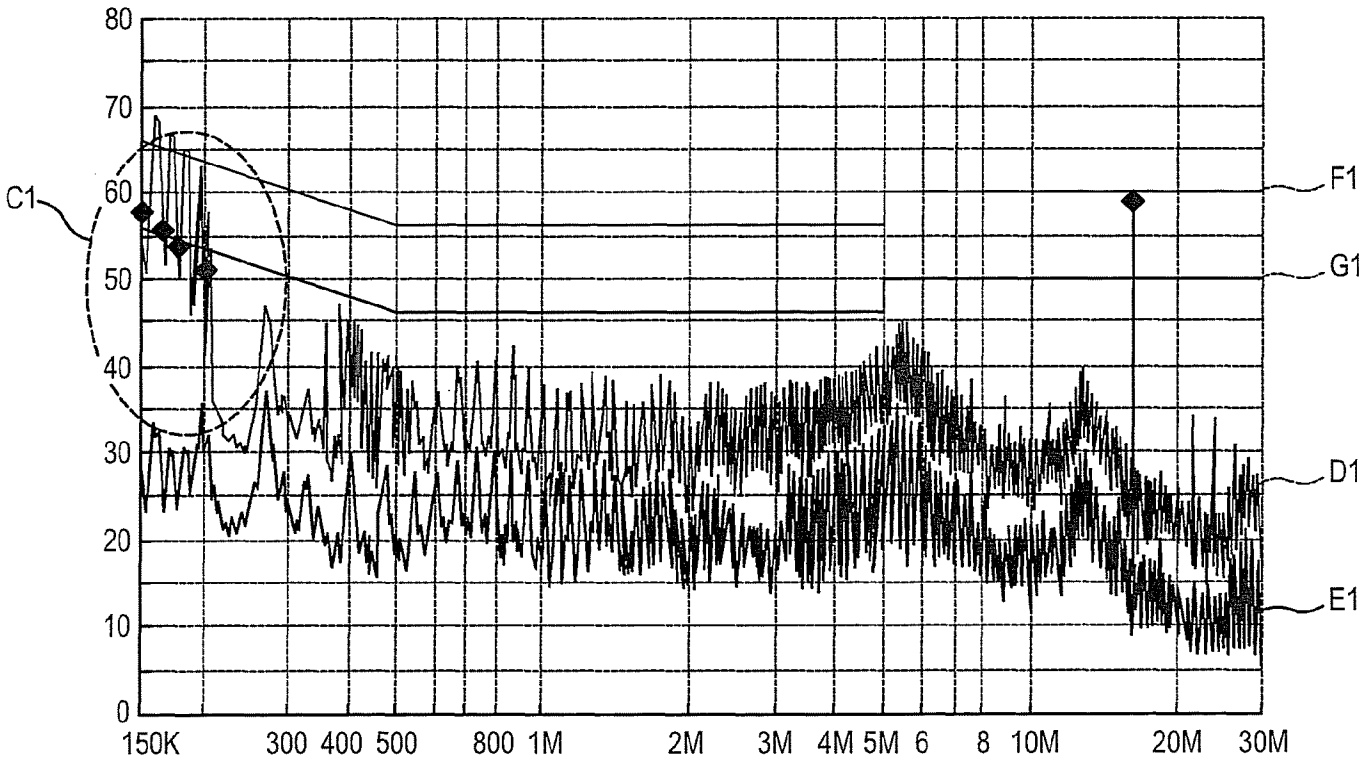
FIG. 3 (RELATED ART)
FIG. 3 illustrates a graph which shows noises occurring during the operation of an image forming apparatus.
Figure 8:
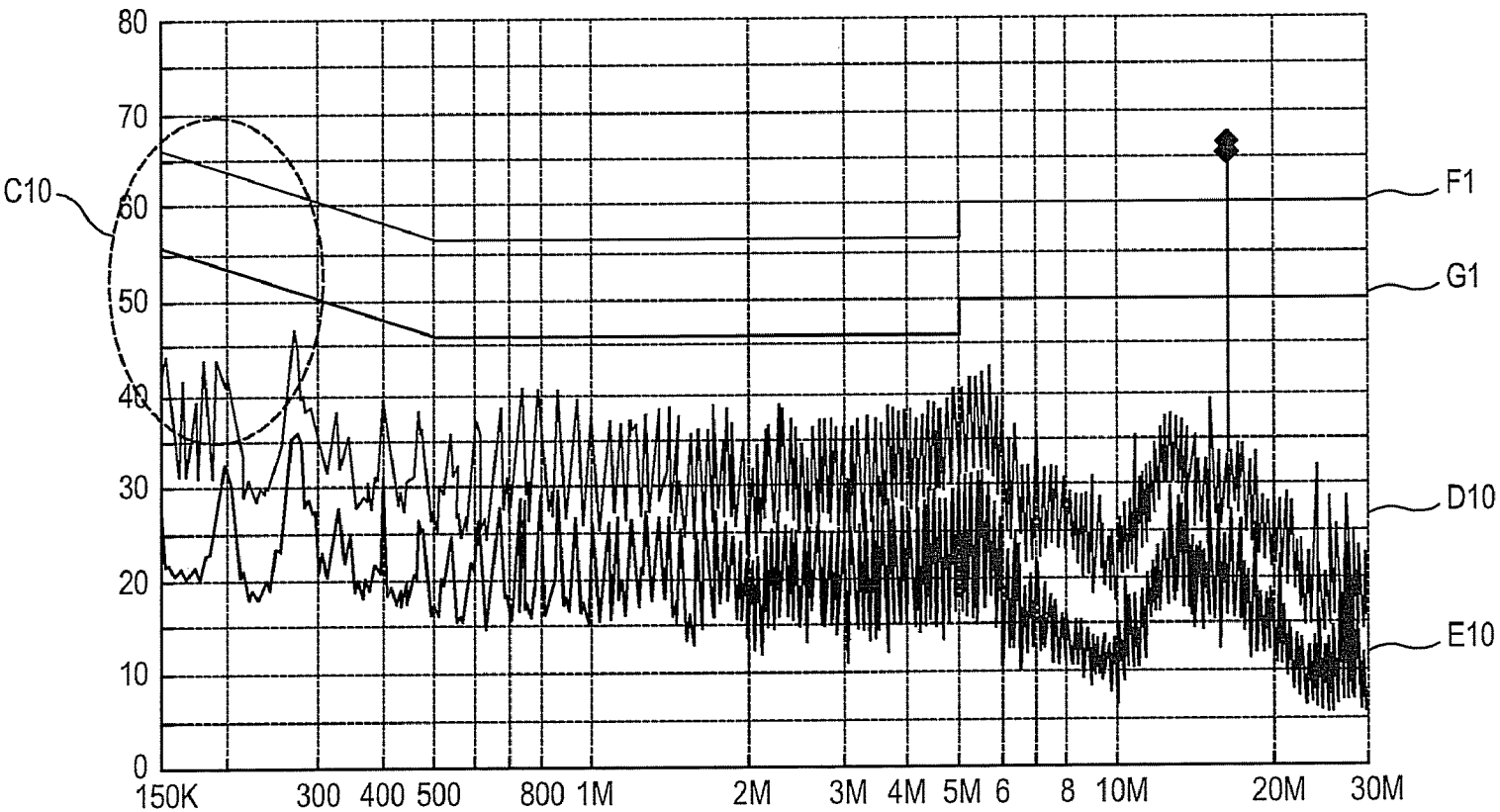
FIG. 8 illustrates a graph which shows noises occurring during an operation of an image forming apparatus according to an example embodiment of the present invention.

FIG. 8 illustrates a graph which shows noises occurring during the operation of the fusing circuit 100*b* according to an example embodiment of the present invention. As shown in FIG. 8, reference numerals D10 and E10 refer to the magnitude of noises measured when a current has the maximum value and the minimum value. Reference numerals F1 and G1 refer to acceptable limits of the noises as shown in FIG. 3. As shown therein, noises drastically decrease in a low frequency band (approximately 150 KHz to 200 KHz) according to an example embodiment of the present invention, compared with C1, shown in FIG. 3.

Figure 9:
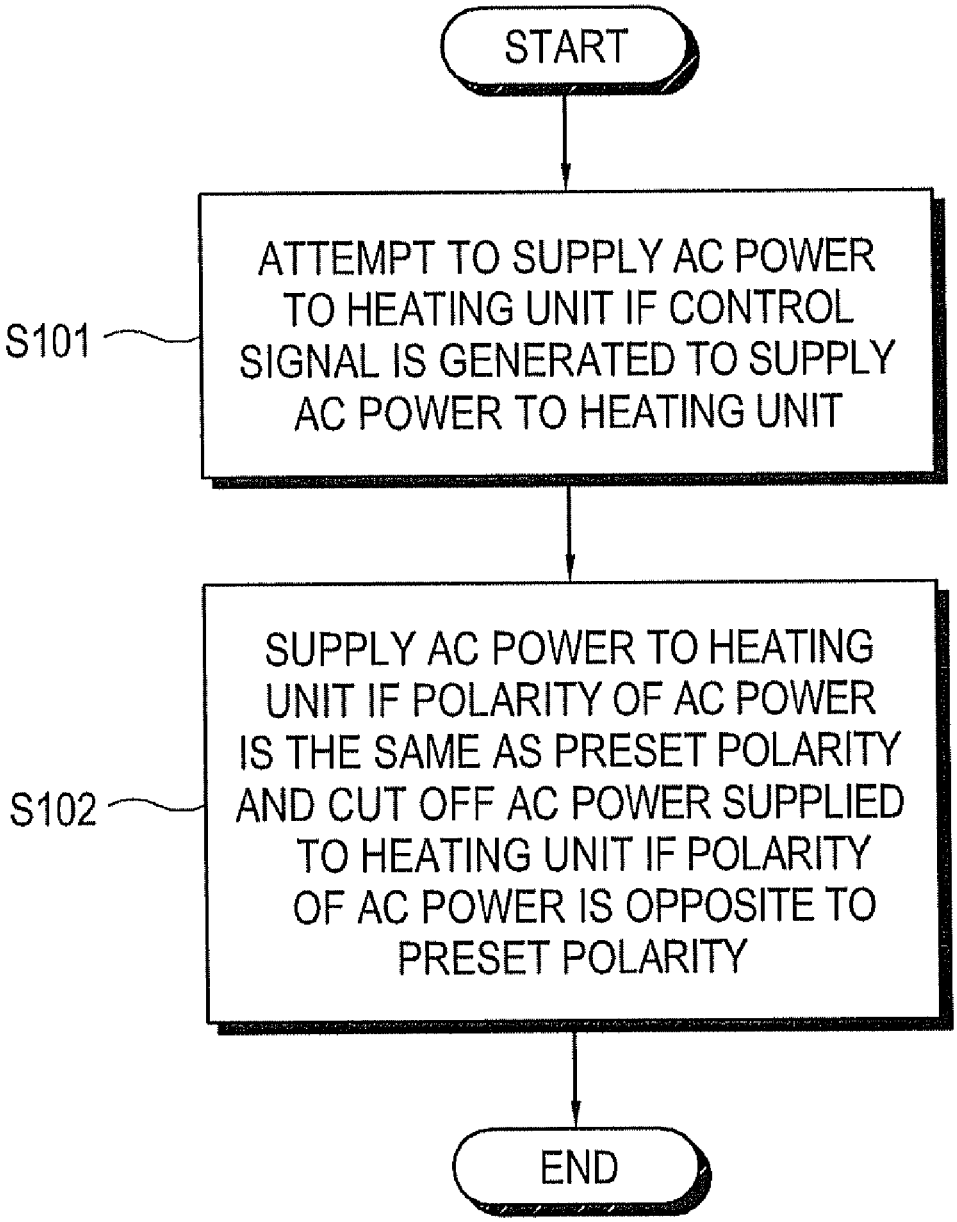
FIG. 9 is a flowchart which describes a control method of an image forming apparatus according to an example embodiment of the present invention.

FIG. 9 is a flowchart which describes a control method of a fusing circuit for driving operation of a heating unit in an image forming apparatus according to an example embodiment of the present invention. The fusing circuit according to an example embodiment of the present invention may include a fusing circuit 100, 100*a* or 100*b* which is shown in FIG. 4, 6 or 7.

If the control signal is generated to supply the AC power to the heating unit 101, an attempt to supply the AC power to the heating unit 101 is made at operation S101. The control signal generated at operation S101 to supply the AC power to the heating unit 101 may include the control signal, the first control signal or the second control signal in FIG. 4, 6 or 7. The process of attempting to supply the AC power to the heating unit 101 may include a process of transmitting the trigger signal to the gate of the triac Q10 according to the control signal, the first control signal or the second control signal by the first transistor Q20 and the first photo-couplers PC10*a* and PC10*b*, or by the second transistor Q22 and the second photo couplers PC12*a* and PC12*b*.

If the polarity of the AC power to be supplied to the heating unit 101 is to the same as the preset polarity, the AC power is supplied to the heating unit 101 at operation S102. If the polarity of the AC power is opposite to the preset polarity, the AC power supplied to the heating unit 101 is cut off at operation S102. At operation S102, the polarity of the AC power and the arrangement directions of the first diode 102 or the second diode 122 may determine whether the polarity of the AC power is equivalent to the preset polarity. The process of supplying the AC power to the heating unit 101 may include a process of transmitting the trigger signal generated by the first light receiver PC10*b* or the second light receiver PC12*b* to the gate of the triac Q10 through the first diode 102 or the second diode 122 and turning on the triac Q10.

The process of cutting off the AC power supplied to the heating unit 101 may include a process of cutting off the trigger signal generated by the first light receiver PC10*b* or the second light receiver PC12*b* by the first diode 102 or the second diode 122 so as not to be supplied to the gate of the triac Q10, and not turning on the triac Q10.

As described above, the present invention provides an image forming apparatus which minimizes noises during a fusing operation, prevents from adversely affecting electronic devices near or around the image forming apparatus and improves reliability, and a control method thereof.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the fusing circuit, shown in FIG. 4, FIG. 6 and FIG. 7, may be incorporated into the main controller of an image forming apparatus. Individual circuit components of the fusing circuit, shown in FIG. 4, FIG. 6 and FIG. 7, can be replaced by equivalent IC, as long as noises can be contained in substantially the same way. Accordingly, it is intended, therefore, that the present invention not be limited to the various example embodiments disclosed, but that the present invention includes all embodiments falling within the scope of the appended claims.

What is claimed is:

1. An image forming apparatus comprising:

a heating unit which generates heat to fuse a toner on a printing medium to form an image; and a fusing circuit which drives operation of the heating unit, wherein the fusing circuit comprises:

a switch which selectively supplies alternating current (AC) power to the heating unit;

a first switching driver which drives the switch to supply the AC power to the heating unit; and a first supply limiter which allows the AC power to be supplied to the heating unit by the first switching driver if a polarity of the AC power is the same as a preset polarity, and which cuts off the AC power supplied to the heating unit if the polarity of the AC power is opposite to the preset polarity.

2. The image forming apparatus according to claim 1, wherein the switch comprises a triac, and wherein the first switching driver triggers a gate of the triac.

3. The image forming apparatus according to claim 2, wherein the first switching driver comprises a first photo-coupler which is turned ON upon receipt of a control signal when a polarity of the AC power is reverse.

4. The image forming apparatus according to claim 3, wherein the first switching driver further comprises a first transistor which is turned ON to allow the first photo-coupler to operate if the control signal is received.

5. The image forming apparatus according to claim 3, wherein the first supply limiter comprises a first diode which is disposed between the gate of the triac and an output terminal of the first photo-coupler.

6. The image forming apparatus according to claim 1, further comprising:

a second switching driver which drives the switch to supply AC power having a polarity opposite to that of the AC power supplied by the first switching driver, to the heating unit; and a second supply limiter which allows the AC power to be supplied to the heating unit by the second switching driver if the polarity of the AC power is the same as a second polarity opposite to the first polarity, and which cuts off the AC power supplied to the heating unit if the polarity of the AC power is opposite to the second polarity.

7. The image forming apparatus according to claim 6, wherein the switch comprises a triac, and wherein the second switching driver triggers a gate of the triac.

8. The image forming apparatus according to claim 7, wherein the second switching driver comprises a second photo-coupler which is turned ON upon receipt of a control signal when a polarity of the AC power is reverse.

9. The image forming apparatus according to claim 8, wherein the second switching driver further comprises a second transistor which is turned ON to allow the second photo-coupler to operate if the control signal is received.

10. The image forming apparatus according to claim 8, wherein the second supply limiter comprises a second diode which is disposed between the gate of the triac and an output terminal of the second photo-coupler.

11. A control method of an image forming apparatus which has a heating unit generating heat to fuse a toner on a printing medium and form an image, the control method comprising:

attempting to supply alternating current (AC) power to the heating unit if a control signal is generated to supply the AC power to the heating unit; and supplying the AC power to the heating unit if a polarity of the AC power to be supplied to the heating unit is the same as a preset polarity, and terminating the AC power supplied to the heating unit if the polarity of the AC power is opposite to the preset polarity.

12. The control method according to claim 11, wherein the terminating of the AC power comprises preventing a trigger signal from being transmitted from an output terminal of a photo-coupler turned ON by the control signal, to a gate of a triac selectively supplying the AC power to the heating unit.

13. An image forming apparatus comprising:

a heating unit which generates heat to fuse a toner on a printing medium during a fusing operation to form an image; and a fusing circuit which drives operation of the heating unit to minimize noise from occurring during the fusing operation, the fusing circuit comprising:

a switch disposed between a power source and the heating unit, to selectively supply power to the heating unit to generate heat for the fusing operation;

a first switching driver arranged to activate the switch to supply power to the heating unit; and a first supply limiter arranged to enable the power to be supplied to the heating unit, via the first switching driver, if a polarity of the power is the same as a preset polarity, and to disable the power supplied to the heating unit if the polarity of the power is opposite to the preset polarity.

14. The image forming apparatus according to claim 13, wherein the switch comprises a triac having a first input terminal connected to the power source, a second input terminal connected to the heating unit, and a gate driven by the first switching driver.

15. The image forming apparatus according to claim 13, wherein the first switching driver comprises:

a first photo-coupler including a light emitter connected to a voltage terminal to emit light upon receipt of a first control signal, and a light receiver connected to the switch to activate the switch when the polarity of the power is reverse; and a first transistor including a first electrode electrically connected to the voltage terminal, via the light emitter of the first photo-coupler, a second electrode connected to ground, and a gate electrode driven upon receipt of the first control signal.

16. The image forming apparatus according to claim 14, further comprising:

a second switching driver arranged in parallel with the first switching driver, to activate the switch to supply power having a polarity opposite to that of the power supplied by the first switching driver, to the heating unit; and a second supply limiter arranged in parallel with the first supply limiter, to enable the power to be supplied to the heating unit, via the second switching driver, if the polarity of the power is the same as a second polarity opposite to the first polarity, and to disable the power supplied to the heating unit if the polarity of the power is opposite to the second polarity.

17. The image forming apparatus according to claim 16, wherein the second switching driver comprises:

a second photo-coupler arranged in parallel with the first photo-coupler, including a light emitter connected to a voltage terminal to emit light upon receipt of a second control signal, and a light receiver connected to the switch to activate the switch when the polarity of the power is reverse; and a second transistor arranged in parallel with the first transistor, including a first electrode electrically connected to the voltage terminal, via the light emitter of the second photo-coupler, a second electrode connected to ground, and a gate electrode driven upon receipt of the second control signal.

18. The image forming apparatus according to claim 16, wherein the first and second supply limiters comprise first and second diodes arranged in parallel and disposed between the gate of the triac and an output terminal of the first and second photo-couplers.

19. The image forming apparatus according to claim 18, further comprising:

an inductance connected to the power source to remove noise occurring when the power is supplied to the heating unit;

a first resistor and a first capacitor connected in series, and disposed between the inductance and the output terminals of the first and second photo-couplers, to remove noise occurring when the switch is turned ON;

a second resistor and a second capacitor arranged in parallel with the first and second photo-couplers to remove noise occurring when the light receiver of the first and second photo-couplers are turned ON; and a third resistor disposed between the inductance and the light receiver of the first and second photo-couplers.

20. The image forming apparatus according to claim 17, wherein the first and second switching drivers further comprise first and second resistors connected to the gate electrode of the first and second transistors.

* * * * *

UNITED STATES PATENT AND TRADEMARK OFFICE

CERTIFICATE OF CORRECTION

PATENT NO. : 8,000,624 B2
APPLICATION NO. : 12/131255
DATED : August 16, 2011
INVENTOR(S) : Se-Joong Kim It is certified that error appears in the above-identified patent and that said Letters Patent is hereby corrected as shown below:

Title Page Column 1 (Other Publications), Line 4, Delete "Application Partial." and insert -- Application. --, therefor.

Signed and Sealed this
Twenty-eighth Day of February, 2012

David J. Kappos

David J. Kappos
*Director of the United States Patent and Trademark Office*